US008662103B2

(12) United States Patent
Adler et al.

(10) Patent No.: US 8,662,103 B2
(45) Date of Patent: Mar. 4, 2014

(54) HOSE REEL

(75) Inventors: Elad Refael Adler, Jerusalem (IL); Vadim Prokofiev, Kfar Saba (IL)

(73) Assignee: Keter Plastic Ltd., Herzelia (IL)

( * ) Notice: Subject to any disclaimer, the term of this patent is extended or adjusted under 35 U.S.C. 154(b) by 45 days.

(21) Appl. No.: 13/067,689

(22) Filed: Jun. 21, 2011

(65) Prior Publication Data

US 2012/0325953 A1 Dec. 27, 2012

(51) Int. Cl.
*B65H 75/34* (2006.01)

(52) U.S. Cl.
USPC ..... 137/355.16; 137/355.26

(58) Field of Classification Search
USPC ..... 137/355.27, 355.26, 355.2, 355.16; 242/397, 615.3, 607.1, 407.1, 598.5
See application file for complete search history.

(56) References Cited

U.S. PATENT DOCUMENTS

| | | | | |
|---|---|---|---|---|
| 4,220,293 | A * | 9/1980 | Gename | 242/388.1 |
| 4,832,074 | A * | 5/1989 | Li | 137/355.2 |
| 5,622,319 | A * | 4/1997 | Babb et al. | 239/722 |
| 7,121,294 | B1 * | 10/2006 | Pierce | 137/355.27 |

* cited by examiner

*Primary Examiner* — John K Fristoe, Jr.
*Assistant Examiner* — Kevin E Lynn
(74) *Attorney, Agent, or Firm* — Eitan, Mehulal & Sadot

(57) ABSTRACT

The present invention includes a hose reel having side rollers. A hose reel includes: a housing defined by at least one or more base members; a spool rotatably disposed within the housing, wherein the spool is adapted to connect to a flexible hose; a winding mechanism to rotate the spool and to coil the flexible hose around the spool; and one or more rollers associated with said housing, wherein the one or more rollers are able to rotate during coiling of the flexible hose around the spool.

24 Claims, 14 Drawing Sheets

HOSE REEL

FIELD

The present invention is related to the field of hose reels for winding of flexible hoses.

BACKGROUND

A hose may be used for various purposes, for example, for watering a garden or a yard, for putting out a fire, as a game for children in summer time, to fill a remote container of water, to transfer water or other liquid(s) from a first point (e.g., a faucet) to a second point (e.g., a container), or the like.

Some hoses may be flexible, and may be made, for example, from rubber or other elastic material(s). Some hoses may be long, for example, and may reach several meters in length.

A hose reel may be used in order to facilitate storage of a long, flexible hose, when the hose is not in use. For example, a crank or handle may be rotated by a user in order to cause the flexible hose to rotate around a central spool of the hose reel, thereby winding or coiling the flexible hose around the spool and forming a spiral or coiled entity which may be stored more efficiently than a stretched or unfolded flexible hose.

SUMMARY

In accordance with the present invention, a hose reel may include a central spool rotatably disposed within a housing or support frame. The housing may include multiple rods, which may be assembled to form an "X" shape, a "Y" shape, or other suitable structure. The side rods may include rotatable rollers, which may allow a flexible hose to more efficiently reel-in into the hose reel or stretch-out from the hose reel. When not in use, the hose reel may optionally be folded to become a thin, reduced-volume, structure.

In accordance with the present invention, a hose reel may include: a housing defined by at least one or more base members; a spool rotatably disposed within the housing, wherein the spool is adapted to connect to a flexible hose; a winding mechanism to rotate the spool and to coil the flexible hose around the spool; and one or more rollers associated with said housing, wherein the one or more rollers are able to rotate during coiling of the flexible hose around the spool.

In accordance with the present invention, the housing may include a plurality of rods, and the one or more rollers may be partially internal, respectively, to the plurality of rods.

In accordance with the present invention, each one of the rollers may be partially disposed within a channel embedded within each one of the rods, respectively; and each one of the rollers may be partially protruding out of said each one of the rods, respectively, in a direction towards a center of the hose reel.

In accordance with the present invention, the housing may include a plurality of rods, and the one or more rollers may be external, respectively, to the plurality of rods.

In accordance with the present invention, at least one of the plurality of rollers may be covered with external protrusions forming one or more tread patterns.

In accordance with the present invention, each one of the rollers may be able to facilitate coiling of the flexible hose around the spool, by pushing the flexible hose away from the housing.

In accordance with the present invention, the one or more rollers may be formed as one or more, respective, rods which may be integral to said housing.

In accordance with the present invention, a shape of the housing may include a shape selected from the group consisting of: an "X" shape, a cross shape, and a "Y" shape.

In accordance with the present invention, the housing may include: a first set of four rods on a first side of the housing, interconnected through a first pair of rotatable disks; and a second set of four rods on a first side of the housing, interconnected through a second pair of rotatable disks.

In accordance with the present invention, the hose reel may be foldable in response to a snapping motion which rotates the two pairs of rotatable disks.

In accordance with the present invention, in an open position, each one of the rods of the first set of rods may be generally perpendicular to each of two adjacent rods of said first set of rods; and in said open position, each one of the rods of the second set of rods may be generally perpendicular to each of two adjacent rods of said second set of rods.

In accordance with the present invention, in a folded position, each one of the rods of the first set of rods may be generally parallel to two or more other rods of the first set of four rods; and in said closed position, each one of the rods of the second set of rods may be generally parallel to two or more other rods of the second set of four rods.

In accordance with the present invention, the spool may include a connector to detachably attach the flexible hose to the spool.

In accordance with the present invention, a lower part of the hose reel may include two or more wheels to allow manual wheeling of the hose reel.

In accordance with the present invention, the winding mechanism may include a fixed non-folding handle.

In accordance with the present invention, the winding mechanism may include a multiple-position handle able to pivot from a raised position to a lowered position.

In accordance with the present invention, the winding mechanism may include an electric motor.

In accordance with the present invention, at least one of the spool, the housing, and the one or more rollers may be formed of plastic.

In accordance with the present invention, at least one of the spool, the housing, and the one or more rollers may be formed of one or more injected plastic materials.

In accordance with the present invention, substantially all components of the hose reel may be formed of plastic.

In accordance with the present invention, substantially all components of the hose reel may be formed of one or more injected plastic materials.

In accordance with the present invention, the hose reel may further include the hose which may be detachably attached to the spool.

In accordance with the present invention, the one or more rollers, upon rotation, are to reduce friction of the flexible hose with the housing.

In accordance with the present invention, the housing may include a plurality of rods, and at least one of the rods of the housing is also a roller.

The present invention may provide other and/or additional benefits and/or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Applicants have realized that a flexible hose being coiled around a central drum or spool of a hose reel may rub against side rods or side walls or housing of the hose reel, and the friction may slow down the coiling process or may make the coiling process more effort consuming.

Accordingly, the present invention may provide a hose reel in which a support frame, side rods and/or side walls may have rollers or other elements which may reduce the friction with the flexible hose being coiled, thereby facilitating the coiling of the flexible hose. Additionally or alternatively, a hose reel in accordance with the present invention may be capable of reeling, coiling, holding, retaining and/or storing a longer flexible hose, compared, for example, to a conventional hose reel (e.g., having full barrels).

Figure 1:
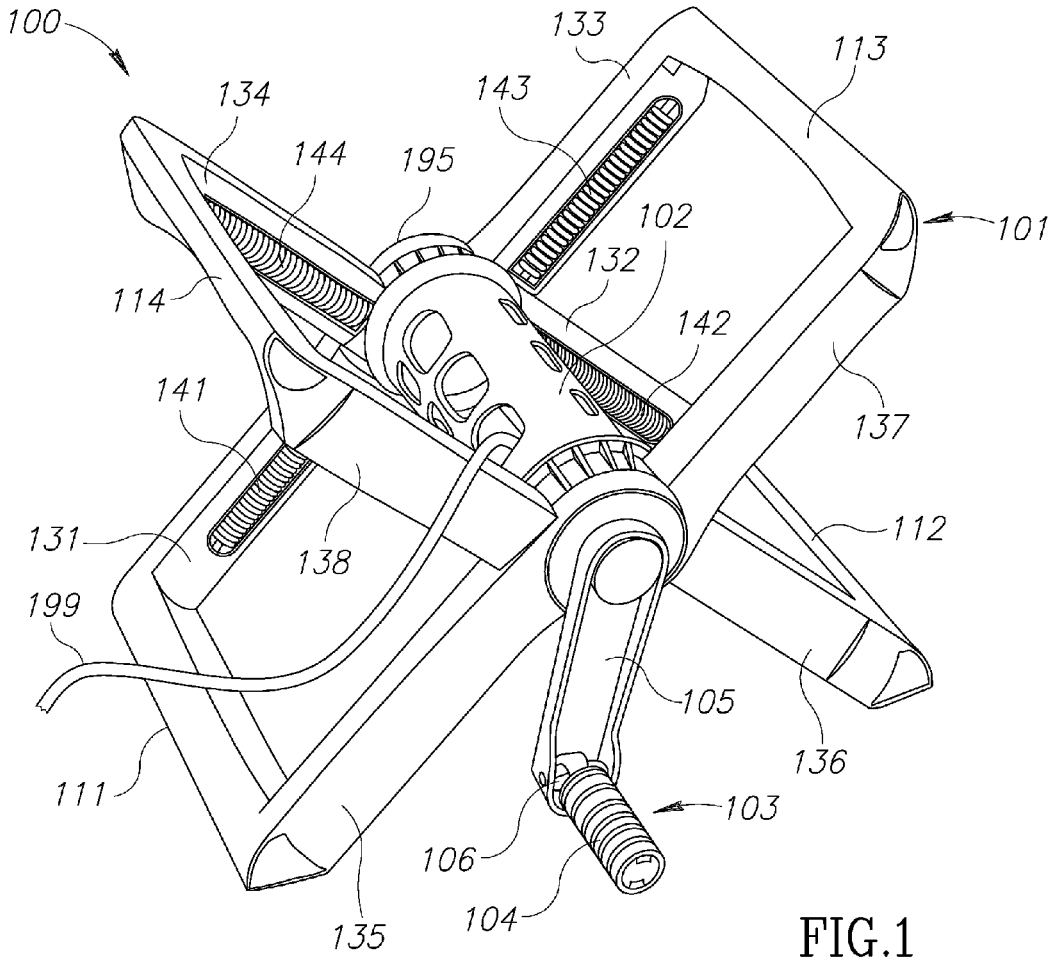
FIG. 1 is a schematic illustration of a perspective view of a hose reel in accordance with the present invention.

Reference is made to FIG. 1, which is a schematic illustration of a perspective view of a hose reel 100 in accordance with the present invention. Hose reel 100 may include, for example, a housing 101, a spool 102, and a handle 103.

The housing 101 may be or may include, for example, a frame or assembly or structure capable of supporting or holding the other components of the hose reel 100. Optionally, the housing 101 may be capable of being positioned on a substantially flat surface (e.g., a floor, a table, the ground), for example, without rocking or shaking. The housing 101 may include four base members 111-114, which may be generally horizontal or generally parallel to the ground or the floor when the hose reel 100 is in use. The base members 111-114 may be interconnected using multiple diagonal rods, for example, four rods 131-134 located on a first side of the hose reel 100, and four rods 135-138 located on a second, opposite, side of the hose reel 100.

The spool 102 may be, for example, a rotatable cylinder or core or drum which may be connected to the handle 103 and which may rotate upon rotation of the handle 103. The handle 103 may be a single-position non-folding handle; or may be a multi-position collapsible handle or crank which may be placed by the user in a lowered (or folded) position or in a raised (or extended) position, by utilizing a folding mechanism 106. For example, the folding mechanism 106 may allow a first portion 104 of the handle 103 to pivot and fold into a second portion 105 of the handle 103.

Rotation of the handle 103 may cause corresponding rotation of the spool 102 about a common axis of rotation, which may be, for example, generally parallel to a surface on which the hose reel 100 may be placed. Such rotation, in turn, may cause winding of a flexible hose 199 which may be connected to the spool 102. The flexible hose 199 may be detachably connected to the spool 102, by using a hose connector or other connection mechanism(s), for example, a clip, a screw, a pair of screws, a pressure-based connector, a male/female connector, a forcible insertion of the flexible hose 199 into a corresponding hole or cavity within the spool 102, or other suitable connection mechanism(s).

The flexible hose 199 may be, for example, a water hose, a garden hose, a rubber hose, a hose able to be folded or coiled or spiraled, a hose for transferring water or other liquid(s) from a first point to a second point, a hose for putting off a fire, an air hose, or the like. The flexible hose 199 may be or may include other type(s) of components, for example, elastic hose, elastic member, elastic element, elongated element, elongated member, or the like. The flexible hose 199 may include, for example, a hollow tube or pipe or tubing elements, capable of carrying or transferring or conveying fluid(s) and/or liquid(s) and/or gas(es) from a first location to another location. The flexible hose 199 may be generally cylindrical in shape, or may have a generally circular cross-section or generally oval cross-section. The flexible hose 199 may be formed of, for example, rubber, natural rubber, synthetic rubber, plastic, nylon, polyurethane, polyethylene, Low Density PolyEthylene (LDPE), Linear LDPE (LLDPE), PolyVinyl Chloride (PVC), PolyTetraFluoroEthylene (PTFE) or Teflon, and/or a combination of two or more such materials or other material(s) (e.g., in order to achieve a particular pressure rating or other characteristics). The flexible hose 199 may be non-metallic or may be substantially metal-free, or alternatively, may include metal components (e.g., metal connectors or endings, stainless steel portions, or the like). The flexible hose 199 may optionally include, or may be, an elongated and/or flexible and/or elastic item or article which may not be capable of transferring fluids; for example, a wire, a cable, an electric cable or wire, a chain, a rope, a string, a cord, a power cord, and/or other element which may be elongated and which may be subject to bending, coiling, wrapping, reeling, winding, folding, spiraling, or otherwise morphing or modifying its dimension(s). Such elements or components or items, even if not being a hose, may be regarded as equivalents and may be included in the terms "hose" or "flexible hose" as used herein; and the present invention may be used in conjunction with such types of elements, components or items.

Optionally, the spool 102 may end with the handle 103 on a first side, and may end with a plunger or terminator on a second, opposite, side; or may end on the second side with an adapter 195 allowing a user to connect to the spool a second (e.g., shorter) flexible hose, thereby allowing transfer of water or other liquid(s) from the second flexible hose, through the spool 102, to the flexible hose 199.

In accordance with the present invention, each one of rods 131-138 may include, in its internal side (e.g., the side facing towards the spool 102), a roller. FIG. 1 shows four such rollers 141-144 in the internal sides of rods 131-134, respectively; similar rollers may be included in the internal sides of rods 135-138, which are hidden from view in FIG. 1. Each one of rollers 141-144 may be able to roll or spin around an axis, or may include beads or circular components capable of spinning (e.g., similar to beads on a rod within an abacus), or may include coils or springs or other suitable elements.

As the flexible hose 199 is being coiled around the spool 102, the flexible hose 199 may touch one or more of the rollers 141-144, and may cause such roller(s) 141-144 to spin or rotate, thereby reciprocating with the flexible hose 199 and pushing the flexible hose 199 towards the center of the hose reel 100 and away from the respective rod 131-138. This may facilitate the coiling of the flexible hose 199 around the spool 102.

Optionally, the rods 131-138 may be structured to be foldable relative to each other. For example, in an expanded or open position, rod 131 may be substantially perpendicular to rod 134; rod 132 may be substantially perpendicular to rod 133; rod 137 may be substantially perpendicular to rod 136; and rod 135 may be substantially perpendicular to rod 138. In a folded position, rod 131 may be substantially parallel to rod 134; rod 132 may be substantially parallel to rod 133; rod 137 may be substantially parallel to rod 136; and rod 135 may be substantially parallel to rod 138.

Rollers 141-144 may be completely external to their respective rods 131-134; or alternatively, rollers 141-144 may be partially external and partially internal to their respective rods 131-134. For example, each one of rods 131-134 may include a channel or crater or cavity, in which the rollers 141-144 may lie while slightly or partially protruding from the rod 141-144 towards the center of the hose reel 100.

Figure 2:
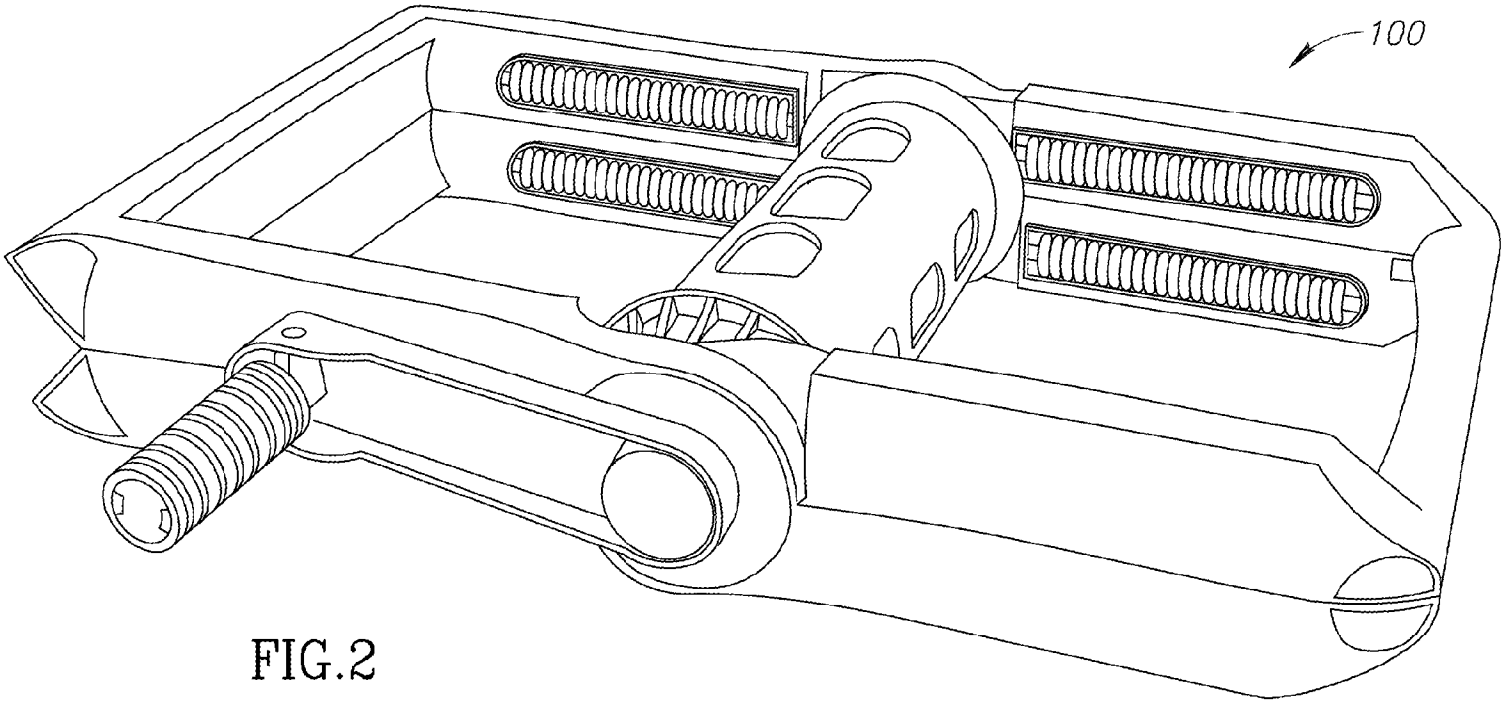
FIG. 2 is a schematic illustration of the hose reel in a folded position, in accordance with the present invention.

Reference is made to FIG. 2, which is a schematic illustration of the hose reel 100 in a folded position, in accordance with the present invention. As depicted, the hose reel 100 may assume a substantially flat structure when fully folded, thereby occupying only a fraction of the volume which a fully-expanded hose reel 100 may occupy. The foldable hose reel 100 may thus be efficiently shipped or stored (e.g., at a store, or at a user location) by folding the hose reel 100 prior to such shipping or storage. It is noted that the folding or snapping process, which allows the hose reel 100 to fold or snap or become smaller or more compact in size, is further described herein with reference to FIG. 8 and the components shown therein.

Figure 3:
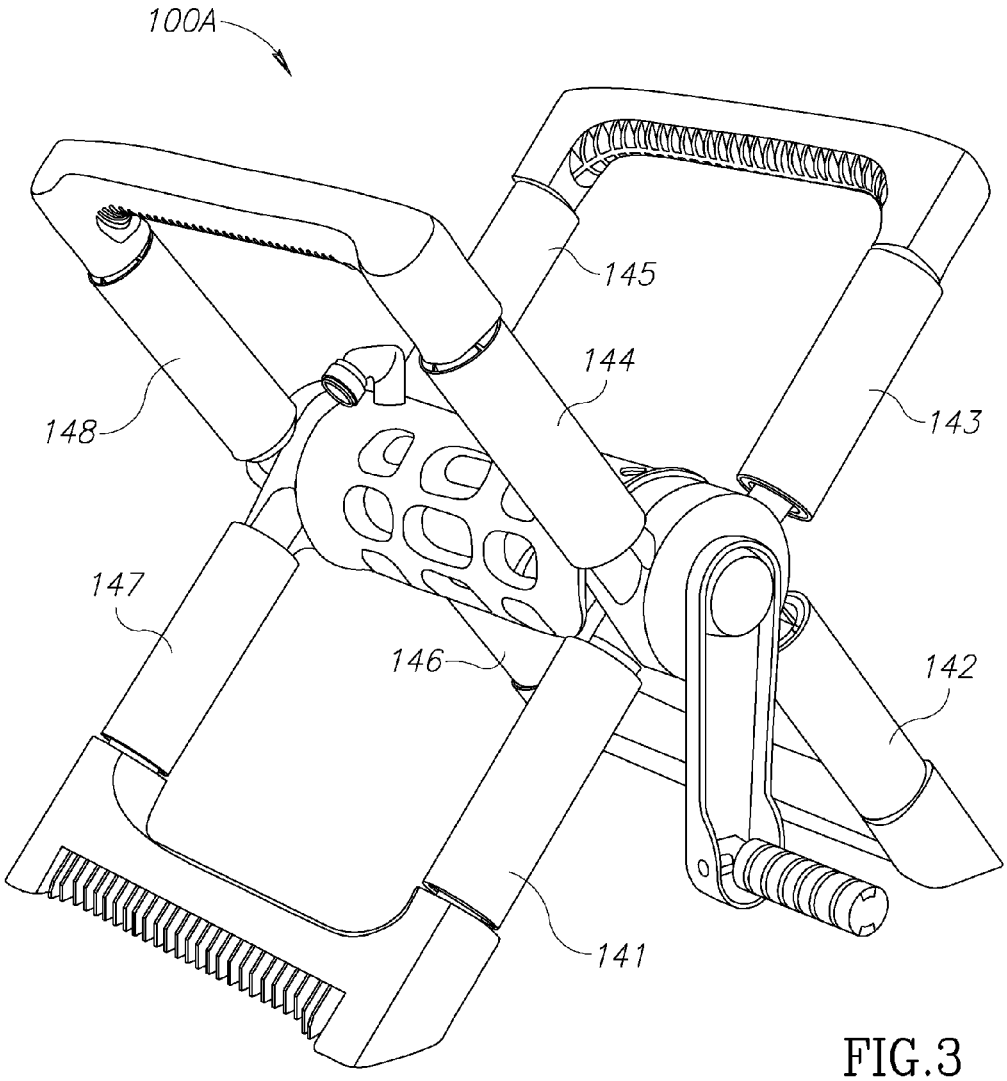
FIG. 3 is a schematic illustration of another implementation of a hose reel, in accordance with the present invention.

Reference is made to FIG. 3, which is a schematic illustration of another implementation of a hose reel 100A, in accordance with the present invention. Hose reel 100A may be generally similar to hose reel 100 of FIGS. 1 and 2. However, in the implementation shown in FIG. 3, instead of having semi-internal rollers (similar to rollers 141-144 of FIG. 1), the hose reel 100A of FIG. 3 may include external rollers, for example, rollers 141-148 which may be external to their corresponding rods, or which may constitute such rods as an integral part of the housing 101 (e.g., a roller may be also a rod, and vice versa).

Figure 4:
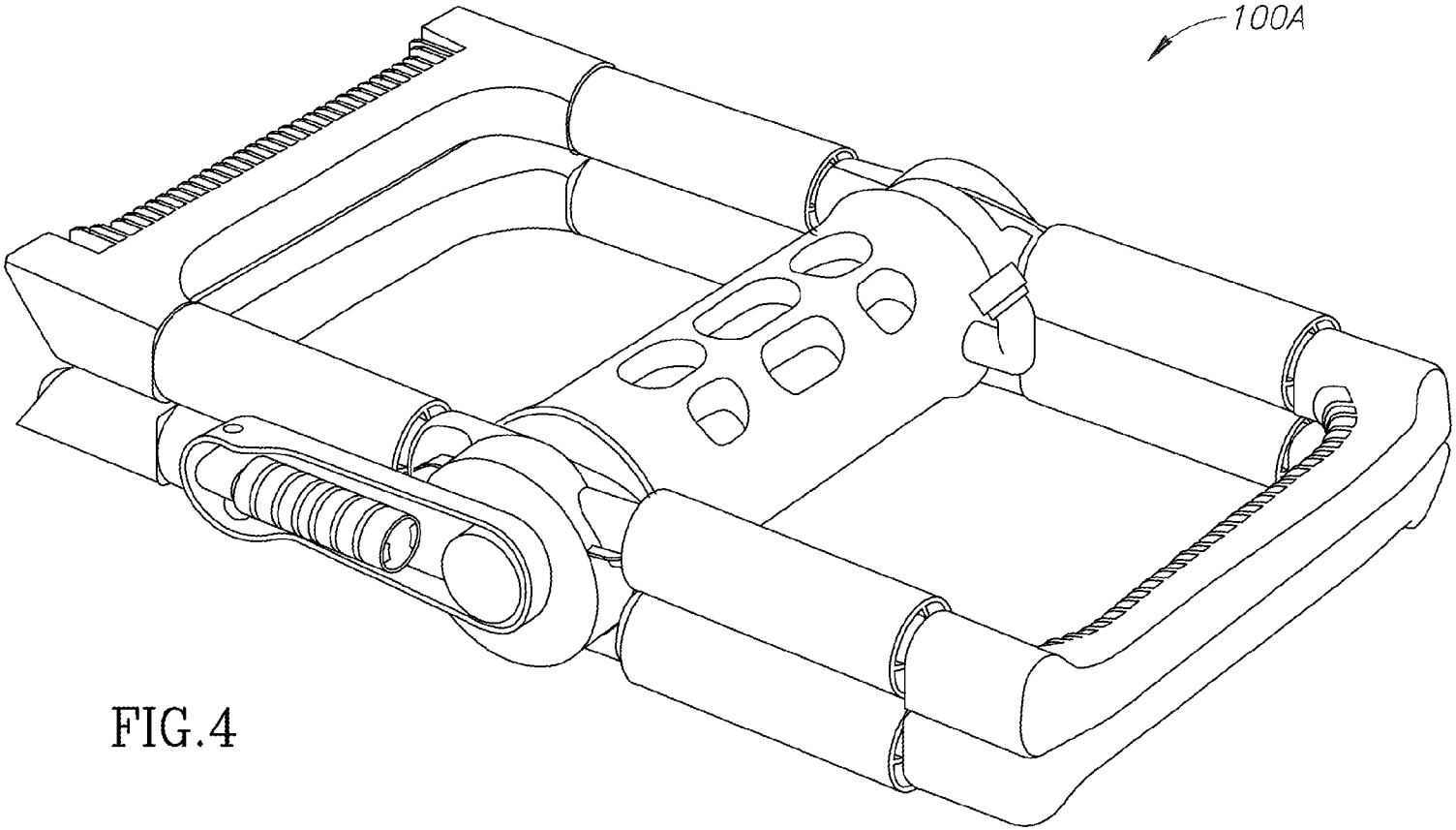
FIG. 4 is a schematic illustration of the hose reel of FIG. 3 in a folded position, in accordance with the present invention.

Reference is made to FIG. 4, which is a schematic illustration of the hose reel 100A of FIG. 3 in a folded position, in accordance with the present invention. As shown, the hose reel 100 may assume a substantially flat structure when fully folded.

Figure 5:
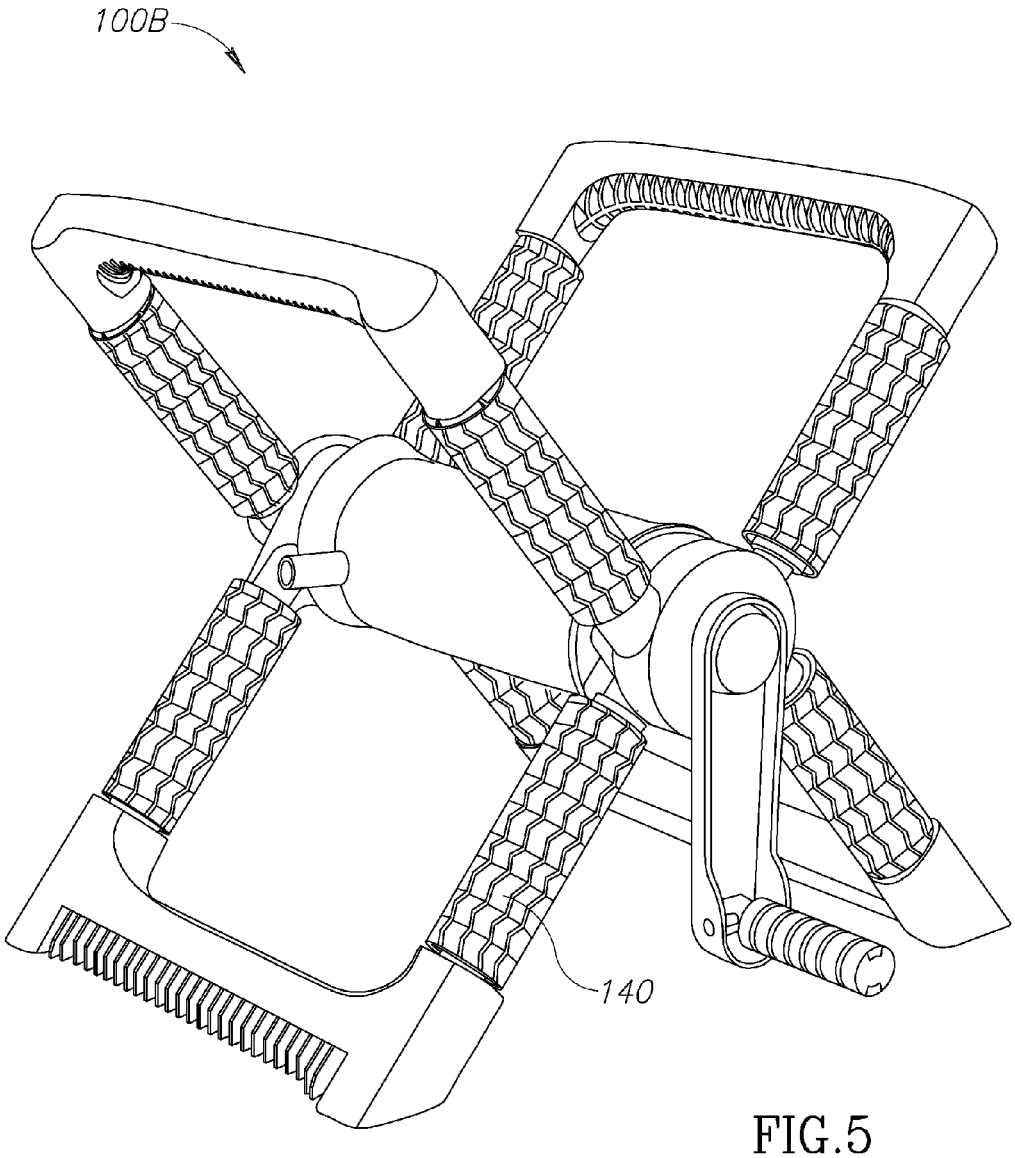
FIG. 5 is a schematic illustration of still another implementation of a hose reel, in accordance with the present invention.

Reference is made to FIG. 5, which is a schematic illustration of still another implementation of a hose reel 100B, in accordance with the present invention. Hose reel 100B may be generally similar to hose reel 100 of FIGS. 1 and 2. However, in the implementation shown in FIG. 5, each one of the external rollers 141-148 may include external protrusions 140 or bumps (e.g., multiple tread designs which may be uniform or different in shape, size, pattern, or other characteristics) which may slightly protrude out from the external rollers 141-148, and may assist in pushing the flexible hose 199 away from the rods 131-138 and/or in reducing the friction between the flexible hose 199 and the rods 131-138 and/or otherwise facilitating the coiling of the flexible hose 199 around the spool 102.

Figure 6:
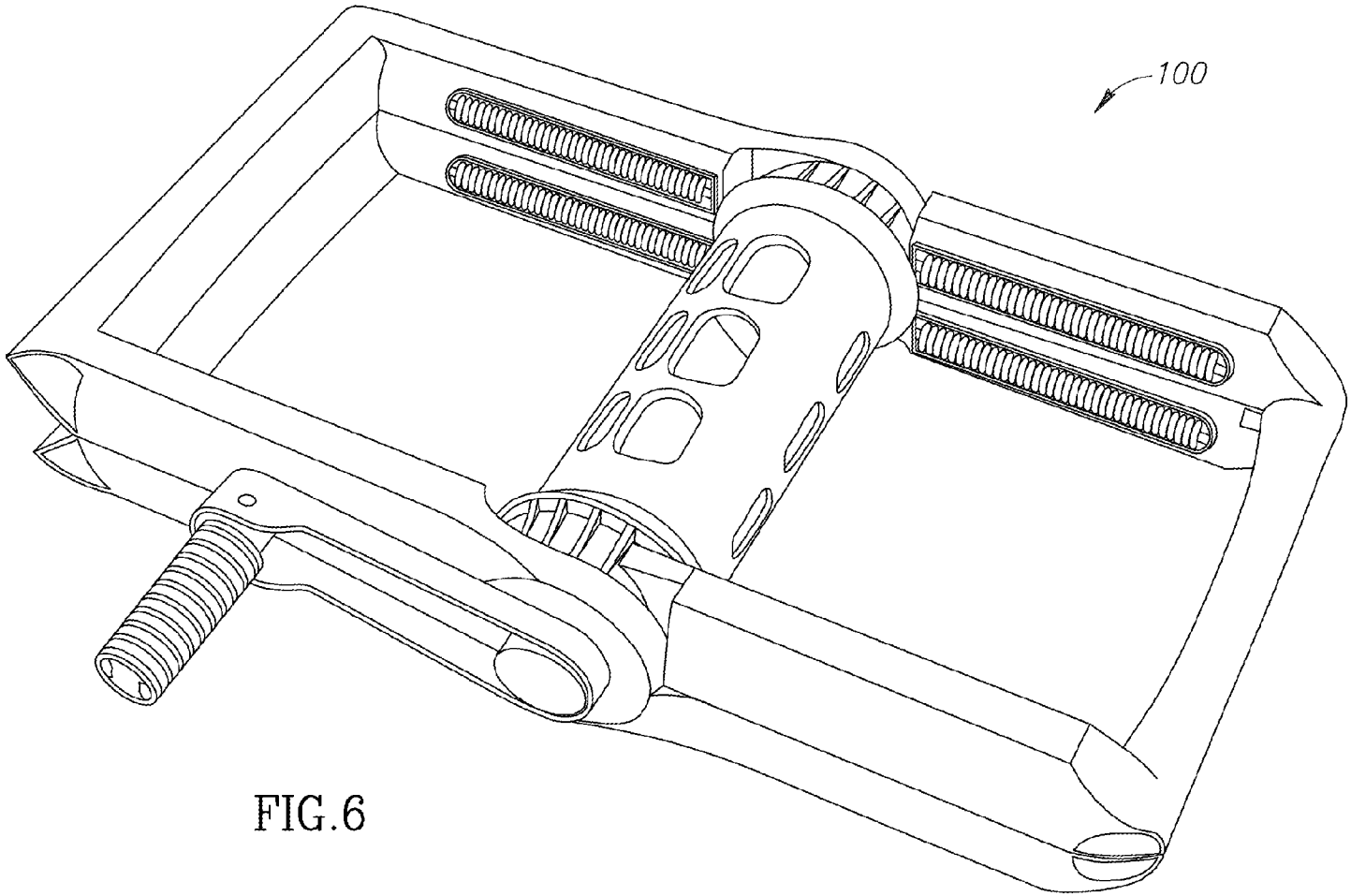
FIG. 6 is a schematic illustration of an implementation of the hose reel of FIG. 1 in a folded position, in accordance with the present invention.
Figure 7:
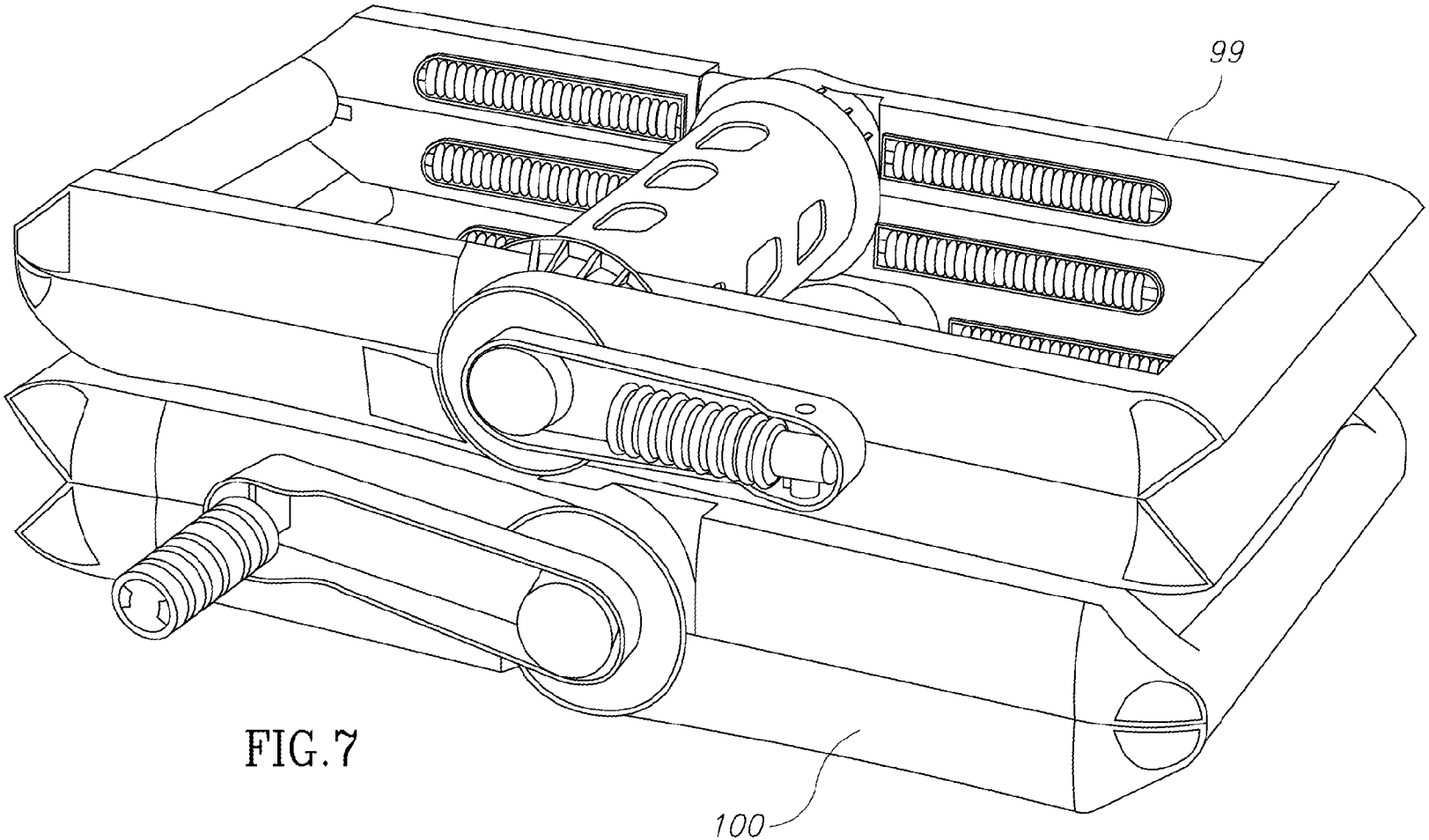
FIG. 7 is a schematic illustration of two stacked hose reels, in accordance with the present invention.

Reference is made to FIG. 6, which is a schematic illustration of an implementation of hose reel 100 in a folded position, in accordance with the present invention; as well as to FIG. 7, which is a schematic illustration of two stacked hose reels which are labeled here as 99 and 100. As shown, hose reels 99 and 100 may be stackable, in order to allow stable and/or efficient storage or shipping of multiple hose reel units.

Figure 8:
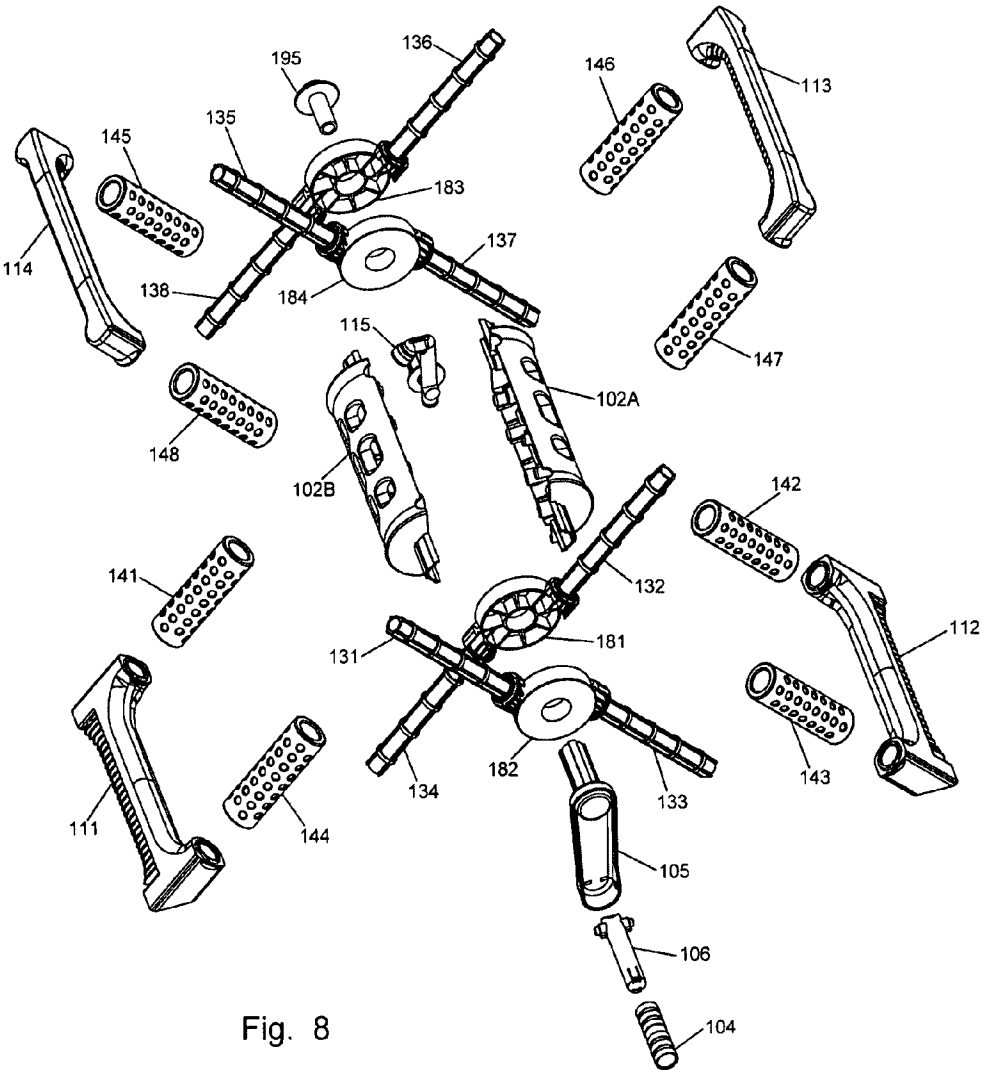
FIG. 8 is a schematic illustration of an exploded view of a hose reel, in accordance with the present invention.

Reference is made to FIG. 8, which is a schematic illustration of an exploded view of hose reel 100B of FIG. 5, in accordance with the present invention. All eight external rollers 141-148 are shown, corresponding to eight rods 131-138. It is noted that optionally, each rod 131-138 and its respective roller 141-148 may be implemented as a pair of components, or as a single unified component (e.g., the roller may be also the rod, and the rod may be also the roller). The spool 102 is shown as exploded into two portions, denoted 102A and 102B; and a hose connector 115 may be disposed within the spool 102 or may be connected to, or embedded in, the spool 102. Further shown is the adapter 195 for connecting a secondary flexible hose, at the end of the spool 102 opposite the handle 103.

Optionally, rods 131 and 132 may be interconnected through a disk 181; and rods 133 and 134 may be interconnected through a disk 182. Disk 181 may fit within or around disk 182. Furthermore, disk 181 may be able to rotate relative to disk 182, or vice versa. Similarly, rods 135 and 136 may be interconnected through a disk 183; and rods 137 and 138 may be interconnected through a disk 184. Disk 183 may fit within or around disk 184. Furthermore, disk 183 may be able to rotate relative to disk 184, or vice versa. This structure may allow folding of the hose reel 100, by applying a snapping motion in order to snap the rods 131-138 from an open position to a closed position.

Figure 9:
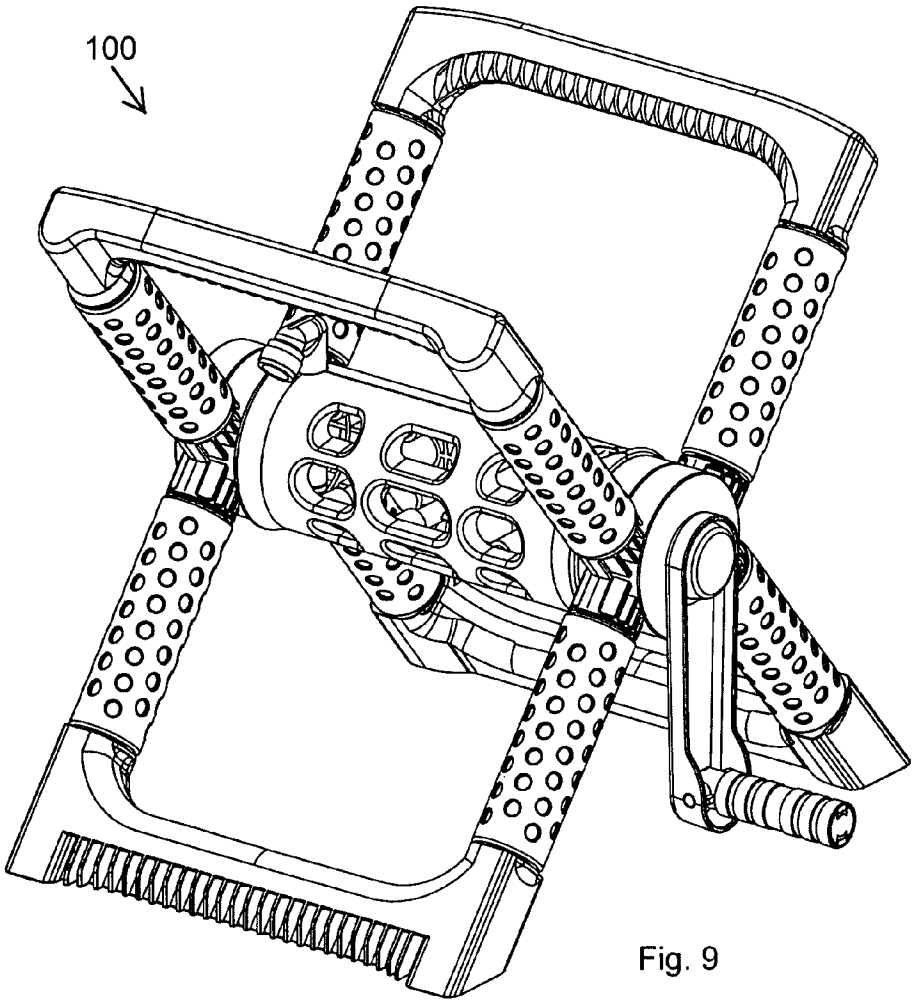
FIG. 9 is a schematic illustration of a hose reel in an open position, in accordance with the present invention.
Figure 10:
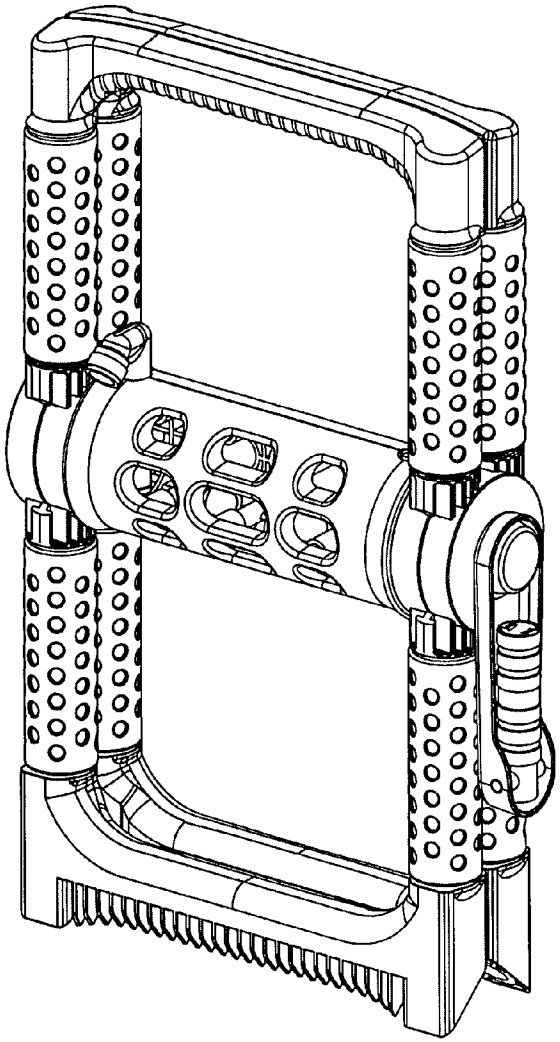
FIG. 10 is a schematic illustration of the hose reel of FIG. 9 in a folded position, in accordance with the present invention.
Figure 11:
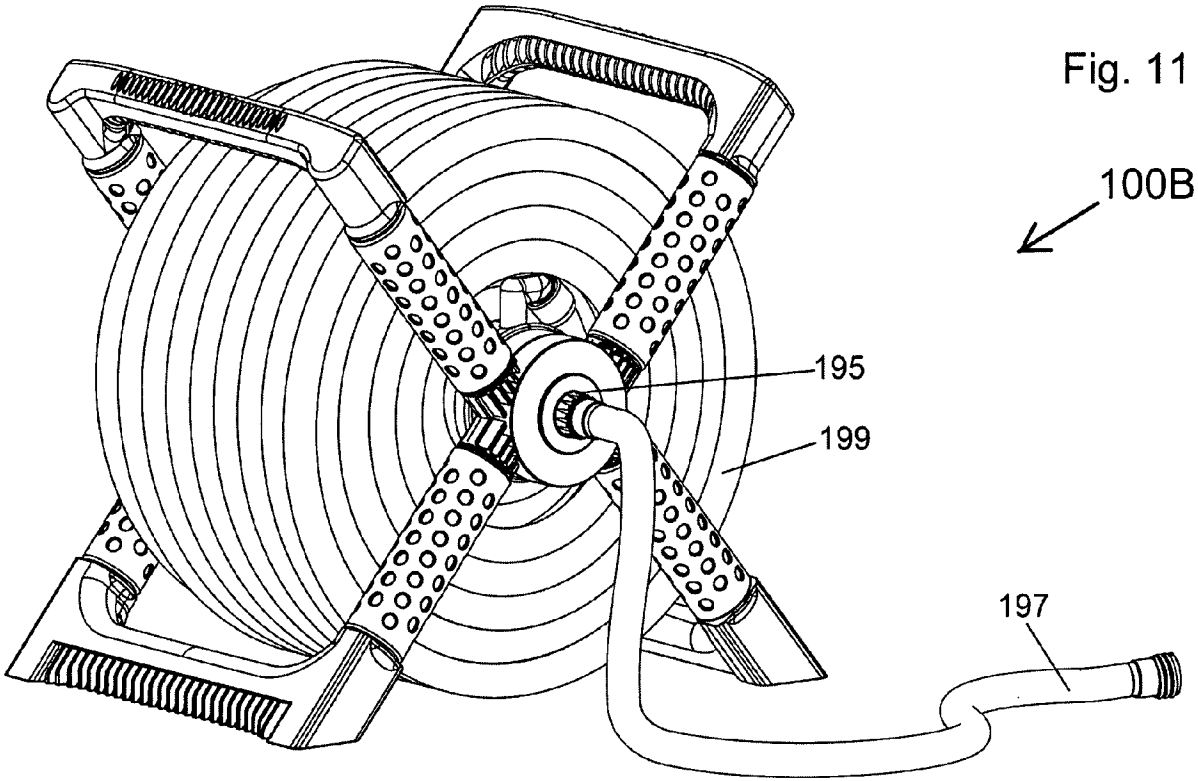
FIGS. 11-14 are schematic illustrations of four views of a hose reel with a flexible hose coiled therein, in accordance with the present invention.
Figure 12:
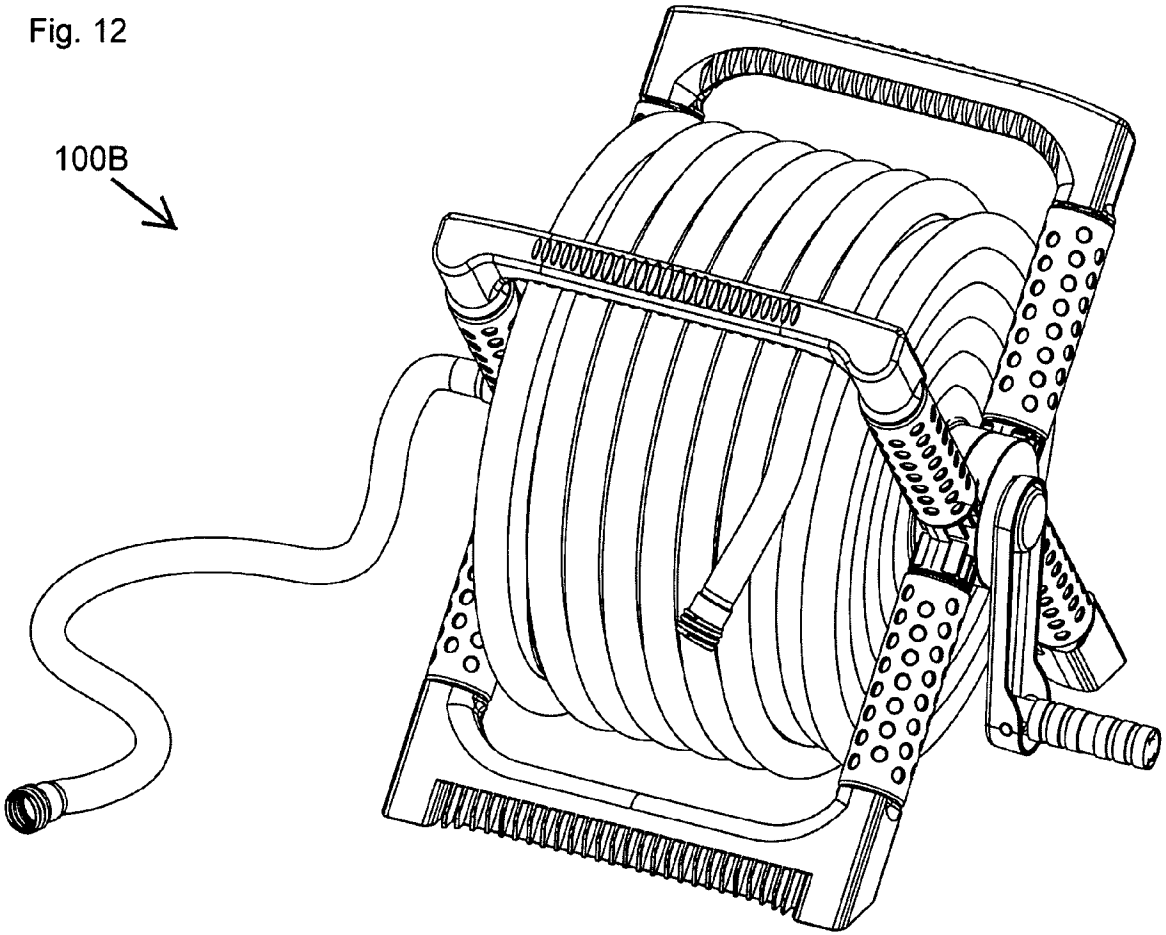
Figure 13:
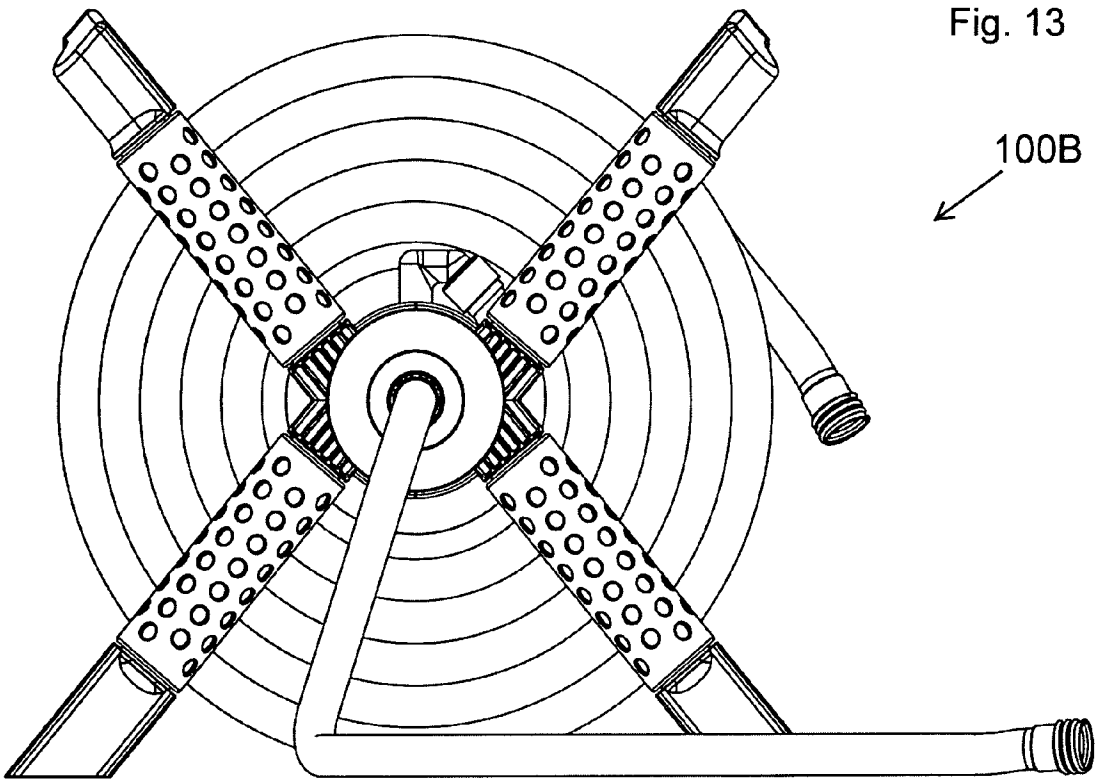
Figure 14:
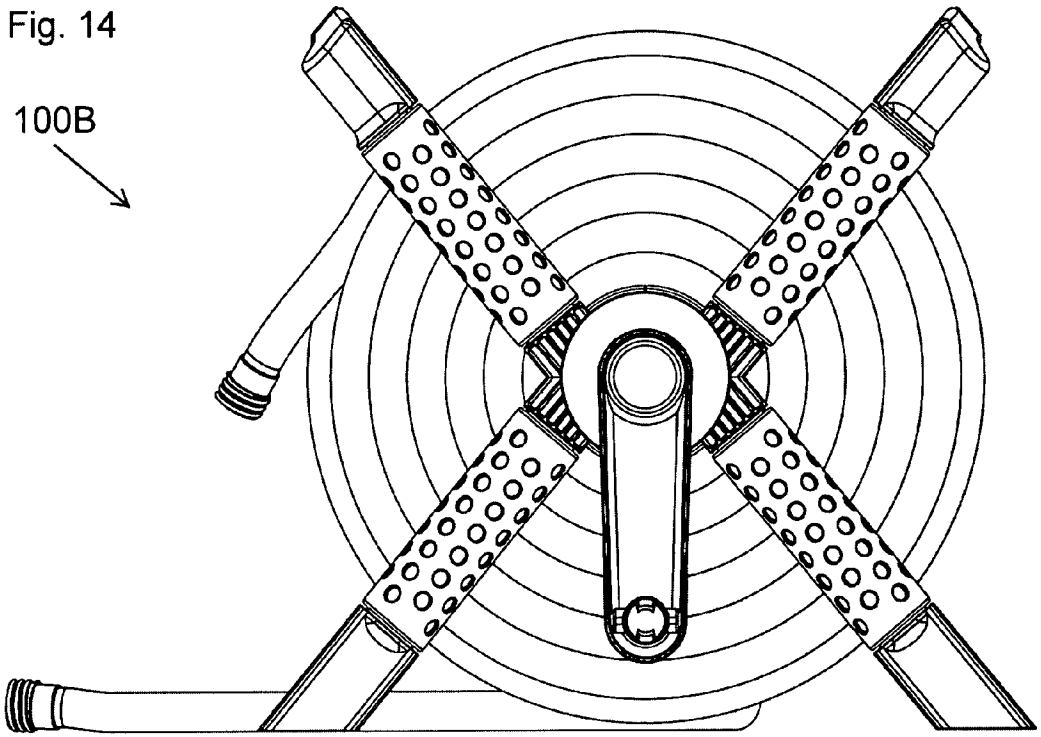

Reference is made to FIG. 9, which is a schematic illustration of the hose reel 100 in an open position; and to FIG. 10, which is a schematic illustration of the hose reel 100 in a folded position, in accordance with the present invention.

Reference is made to FIGS. 11-14, which are schematic illustrations of four views of hose reel 100B, in accordance with the present invention. Shown is the flexible hose 199 coiled around the spool 102; as well as a secondary hose 197 which may be connected to the adapter 195.

In accordance with the present invention, each side of the hose reel 100 (i.e., the right side, and the left side) may have four rods (as shown), or three rods (e.g., arrange in a "Y" shape), or other suitable number of rods. Optionally, instead of rods or in addition to rods, side walls or side panels or side plates may be used, and may include internal and/or external rollers.

In accordance with the present invention, hose reel 100 may be, for example, generally "X"-shaped, generally "+"

shaped ("plus"-shaped), generally cross-shaped, generally "Y"-shaped, or may have other suitable structure.

The present invention may be implemented, for example, as a hose reel cart or as a hose reel having supporting wheels, thereby allowing a user to more easily push or move the hose reel by taking advantage of such wheels. Optionally, the hose reel of the present invention may be used in conjunction with a "hose hide-away" box or housing which may surround or wrap or encompass the hose reel, may hide the coiled flexible hose from plain sight and/or from environmental conditions (e.g., rain, snow, sunlight), or may otherwise provide a boxed housing to the hose reel. Other suitable implementations may be used.

The present invention may be implemented, for example, as an electric hose reel or an automatic or semi-automatic hose reel which may utilize electric power, hydraulic power, spring-based power, manual power, or other type of power or forces or a combination thereof. Such hose reels may benefit from having rollers embedded within, or mounted on, one or more side rods, side panel, side walls, or other suitable members of such hose reels.

The hose reel 100 may be formed of plastic; or, one or more components may be formed of plastic. Optionally, one or more of the components of hose reel 100 may be formed of injection molding of one or more raw plastic material(s). The present invention may be exercised using other suitable materials, for example, wood, metal(s), or the like; and/or using plastic components which may be formed by injection molding or by other plastic manufacturing processes. For example, a hose reel may be formed or assembled such that substantially all the components of the hose reel, in accordance with the present invention, may be formed or plastic, or injected plastic material(s), or wood, or metal, or the like. Optionally, at least the spool and/or one or more of the rods and/or the rollers, may be formed or plastic, or injected plastic material(s), or wood, or metal, or the like. Other suitable material(s) or combinations of materials may be used.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments of the present invention have been illustrated and described herein, many modifications, substitutions, changes, and equivalents may occur to those skilled in the art. Accordingly, the claims are intended to cover all such modifications, substitutions, changes, and equivalents.

What is claimed is:

1. A hose reel comprising:

a housing defined by at least (A) two base members (111-112);

(B) a right-side set of four rods (131-134) located on a right side of the housing and interconnected by a first set of one or more rotatable disk (181, 182) and forming a right-side X-shape of four rods; and (C) a left-side set of four rods (135-139) located on left side of the housing and interconnected by a second set of one or more rotatable disk (183, 184) and forming a left-side X-shape of four rods;

wherein the right-side X-shape of four rods (131-134) is parallel to the left-side X-shape of four rods (135-138);

a spool rotatably disposed within the housing, wherein the spool is adapted to connect to a flexible hose;

wherein a longest dimension of said spool is parallel to each of said two base members (111-112);

wherein each rod of the right-side set of four rods (131-134) is perpendicular to said longest dimension of said spool;

wherein each rod of the left-side set of four rods (135-138) is perpendicular to sais longest dimension of said spool;

a winding mechanism to rotate the spool and to coil the flexible hose around the spool; and a plurality of rollers associated with said housing, each roller connected to a respective rod, wherein each of said rollers is able (a) to rotate during coiling of the flexible hose around the spool, and (b) to push the flexible hose towards a center of the hose reel and away from the respective rod connected to said each roller;

wherein at least one of the plurality of rollers is covered with external protrusions forming one or more tread patterns to push the flexible hose away from the respective rod connected to said at least one of the rollers;

wherein the plurality of rollers comprise:

(i) a right-side set of four rollers (141-144) inter-connected and forming a right-side X-shape of four rollers, and (ii) a left-side set of four rollers (145-148) inter-connected and forming a left-side X-shape of four rollers;

wherein the right-side X-shape of four rollers (141-144) is parallel to the left-side X-shape of four rollers (145-148);

wherein each roller of the right-side set of four rollers (141-144) is perpendicular to a long dimension of said spool;

wherein each roller of the left-side set of four rollers (145-148) is perpendicular to said long dimension of said spool.

2. The hose reel of claim 1, wherein at least one of said rollers is partially internal to a respective rod of said rods.

3. The hose reel of claim 1, wherein at least one of said rollers is external to a respective rod of said rods.

4. The hose reel of claim 1, wherein each one of the rollers is able to facilitate coiling of the flexible hose around the spool, by pushing the flexible hose away from the housing.

5. The hose reel of claim 1, wherein one or more of said rollers are formed as one or more, respective, of said rods which are integral to said housing.

6. The hose reel of claim 1, wherein a shape of the housing comprises an "X" shape.

7. The hose reel of claim 1, wherein the hose reel is foldable in response to a snapping motion which rotates the first set of one or more rotatable disks and the second set of one rotatable disks.

8. The hose reel of claim 1, wherein in an open position, each one of the rods of the right-side set of four rods is generally perpendicular to each of two adjacent rods of said right-side set of four rods; and wherein in said open position, each one of the rods of the left-side set of four rods is generally perpendicular to each of two adjacent rods of said left-side set of four rods.

9. The hose reel of claim 8, wherein in a folded position, each one of the rods of the right-side set of four rods is generally parallel to two or more other rods of the right-side set of four rods; and wherein in said closed position, each one of the rods of the left-side set of four rods is generally parallel to two or more other rods of the left-side set of four rods.

10. The hose reel of claim 1, wherein the spool comprises a connector to detachably attach the flexible hose to the spool.

11. The hose reel of claim 1, wherein a lower part of the hose reel comprises two or more wheels to allow manual wheeling of the hose reel.

12. The hose reel of claim 1, wherein the winding mechanism comprises a fixed non-folding handle.

13. The hose reel of claim 1, wherein the winding mechanism comprises a multiple-position handle able to pivot from a raised position to a lowered position.

14. The hose reel of claim 1, wherein the winding mechanism comprises an electric motor.

15. The hose reel of claim 1, wherein at least one of the spool, the housing, and the rollers is formed of plastic.

16. The hose reel of claim 1, wherein at least one of the spool, the housing, and the rollers is formed of one or more injected plastic materials.

17. The hose reel of claim 1, wherein all components of the hose reel are formed of plastic.

18. The hose reel of claim 1, wherein all components of the hose reel are formed of one or more injected plastic materials.

19. The hose reel of claim 1, further comprising said flexible hose, wherein the flexible hose is detachably attached to the spool.

20. The hose reel of claim 1, wherein the rollers, upon rotation, are to reduce friction of the flexible hose with the housing.

21. The hose reel of claim 1, wherein at least one of the rods of the housing is also a roller.

22. The hose reel of claim 1, wherein the hose reel assumes a flat structure when fully folded.

23. The hose reel of claim 1, wherein at least one of said rollers comprises: a plurality of beads capable of spinning.

24. The hose reel of claim 1, wherein each rod of said rods, and each respective roller of said rollers, are implemented as a unified component in which the roller is also the rod and the rod is also the roller.

* * * * *